US009163473B2

(12) United States Patent
Linde et al.

(10) Patent No.: US 9,163,473 B2
(45) Date of Patent: Oct. 20, 2015

(54) REMOTE OPERATION OF A ROTATING CONTROL DEVICE BEARING CLAMP AND SAFETY LATCH

(75) Inventors: Leonard C. Linde, Casper, WY (US); Reece E. Cashion, Conroe, TX (US); Larry D. White, Brenham, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 557 days.

(21) Appl. No.: 13/300,335

(22) Filed: Nov. 18, 2011

(65) Prior Publication Data

US 2012/0125633 A1 May 24, 2012

(30) Foreign Application Priority Data

Nov. 20, 2010 (WO) ..... PCT/US10/57539
Mar. 14, 2011 (WO) ..... PCT/US11/28384

(51) Int. Cl.
*E21B 33/08* (2006.01)
*E21B 33/038* (2006.01)

(52) U.S. Cl.
CPC ..... *E21B 33/085* (2013.01); *E21B 33/038* (2013.01)

(58) Field of Classification Search
CPC ..... E21B 33/085
USPC ..... 166/381, 382, 387, 84.4; 292/256.6, 292/250, 256.69
See application file for complete search history.

(56) References Cited

U.S. PATENT DOCUMENTS 2,643,150 A * 6/1953 Giles ..... 292/256.69
2,684,166 A * 7/1954 De Jarnett ..... 414/626
2,897,895 A 8/1959 Ortloff
3,071,188 A 1/1963 Raulins
3,142,337 A 7/1964 Poorman, Jr. et al.

(Continued)

FOREIGN PATENT DOCUMENTS

EP 1432887 B1 3/2006
EP 1595057 B1 7/2006

(Continued)

OTHER PUBLICATIONS

International Search Report with Written Opinion issued Aug. 19, 2011 for PCT Patent Application No. PCT/US10/057540, 11 pages.

(Continued)

*Primary Examiner* — Brad Harcourt
*Assistant Examiner* — Steven MacDonald
(74) *Attorney, Agent, or Firm* — Chamberlain Hrdlicka

(57) ABSTRACT

An RCD can include a housing assembly which contains a bearing assembly and an annular seal which rotates and seals off an annulus between a tubular string and an RCD body, a remotely operable clamp device which selectively permits and prevents relative displacement between the housing assembly and the body, and a remotely operable safety latch which selectively permits and prevents unclamping of the clamp device. A method of remotely operating an RCD clamp device can include remotely operating a safety latch which selectively permits and prevents unclamping of the clamp device, and remotely operating the clamp device while the safety latch is in an unlatched position, thereby unclamping a bearing housing assembly from the RCD body. Another RCD can include a remotely operable clamp device which selectively permits access to an RCD body interior, and a remotely operable safety latch which selectively prevents unclamping of the clamp device.

18 Claims, 14 Drawing Sheets

(56) References Cited

U.S. PATENT DOCUMENTS

| | | | | | |
|---|---|---|---|---|---|
| 3,163,223 | A | | 12/1964 | Bauer et al. | |
| 3,251,611 | A | | 5/1966 | Haeber et al. | |
| 3,387,851 | A | | 6/1968 | Cugini | |
| 3,472,518 | A | | 10/1969 | Harlan | |
| 3,561,723 | A | | 2/1971 | Cugini | |
| 3,614,111 | A | | 10/1971 | Regan | |
| 3,621,912 | A | | 11/1971 | Woody, Jr. et al. | |
| 3,695,633 | A | | 10/1972 | Hanes | |
| 3,868,832 | A | | 3/1975 | Biffle | |
| 3,965,987 | A | * | 6/1976 | Biffle | 166/379 |
| 3,967,678 | A | | 7/1976 | Blackwell | |
| 4,098,341 | A | | 7/1978 | Lewis | |
| 4,154,448 | A | * | 5/1979 | Biffle | 277/326 |
| 4,185,856 | A | | 1/1980 | McCaskill | |
| 4,258,792 | A | | 3/1981 | Restarick | |
| 4,285,406 | A | | 8/1981 | Garrett et al. | |
| 4,293,047 | A | | 10/1981 | Young | |
| 4,304,310 | A | | 12/1981 | Garrett | |
| 4,312,404 | A | | 1/1982 | Morrow | |
| 4,361,185 | A | * | 11/1982 | Biffle | 166/84.3 |
| 4,367,795 | A | * | 1/1983 | Biffle | 166/84.3 |
| 4,416,340 | A | | 11/1983 | Bailey | |
| 4,441,551 | A | * | 4/1984 | Biffle | 166/84.3 |
| 4,448,255 | A | | 5/1984 | Shaffer et al. | |
| 4,494,609 | A | | 1/1985 | Schwendemann | |
| 4,526,406 | A | | 7/1985 | Nelson | |
| 4,529,210 | A | * | 7/1985 | Biffle | 166/84.3 |
| 4,531,580 | A | | 7/1985 | Jones | |
| 4,546,828 | A | | 10/1985 | Roche | |
| 4,601,608 | A | | 7/1986 | Ahlstone | |
| 4,626,135 | A | | 12/1986 | Roche | |
| 4,673,041 | A | | 6/1987 | Turner et al. | |
| 4,693,497 | A | | 9/1987 | Pettus et al. | |
| 4,754,820 | A | | 7/1988 | Watts et al. | |
| 4,813,495 | A | | 3/1989 | Leach | |
| 4,828,024 | A | | 5/1989 | Roche | |
| 5,022,472 | A | | 6/1991 | Bailey et al. | |
| 5,137,084 | A | | 8/1992 | Gonzales et al. | |
| 5,178,215 | A | | 1/1993 | Yenulis et al. | |
| 5,213,158 | A | | 5/1993 | Bailey et al. | |
| 5,224,557 | A | | 7/1993 | Yenulis et al. | |
| 5,277,249 | A | | 1/1994 | Yenulis et al. | |
| 5,279,365 | A | | 1/1994 | Yenulis et al. | |
| 5,322,137 | A | | 6/1994 | Gonzales | |
| 5,409,073 | A | | 4/1995 | Gonzales | |
| 5,588,491 | A | | 12/1996 | Brugman et al. | |
| 5,647,444 | A | | 7/1997 | Williams | |
| 5,662,181 | A | * | 9/1997 | Williams et al. | 175/195 |
| 5,720,356 | A | | 2/1998 | Gardes | |
| 6,016,880 | A | | 1/2000 | Hall et al. | |
| 6,024,172 | A | | 2/2000 | Lee | |
| 6,065,550 | A | | 5/2000 | Gardes | |
| 6,109,348 | A | | 8/2000 | Caraway | |
| 6,129,152 | A | | 10/2000 | Hosie et al. | |
| 6,138,774 | A | | 10/2000 | Bourgoyne, Jr. et al. | |
| 6,263,982 | B1 | | 7/2001 | Hannegan et al. | |
| 6,276,450 | B1 | | 8/2001 | Senevirante | |
| 6,325,159 | B1 | | 12/2001 | Peterman et al. | |
| 6,457,540 | B2 | | 10/2002 | Gardes | |
| 6,470,975 | B1 | | 10/2002 | Bourgoyne et al. | |
| 6,547,002 | B1 | | 4/2003 | Bailey et al. | |
| 6,554,016 | B2 | | 4/2003 | Kinder | |
| 6,588,502 | B2 | | 7/2003 | Nice | |
| 6,702,012 | B2 | | 3/2004 | Bailey et al. | |
| 6,732,804 | B2 | | 5/2004 | Hosie et al. | |
| 6,749,172 | B2 | | 6/2004 | Kinder | |
| 6,896,076 | B2 | | 5/2005 | Nelson et al. | |
| 6,904,981 | B2 | | 6/2005 | Van Riet | |
| 6,913,092 | B2 | | 7/2005 | Bourgoyne et al. | |
| 6,953,085 | B2 | | 10/2005 | Nice | |
| 6,981,561 | B2 | | 1/2006 | Krueger et al. | |
| 7,004,444 | B2 | | 2/2006 | Kinder | |
| 7,007,913 | B2 | | 3/2006 | Kinder | |
| 7,040,394 | B2 | | 5/2006 | Bailey et al. | |
| 7,044,237 | B2 | | 5/2006 | Leuchtenberg | |
| 7,055,627 | B2 | | 6/2006 | Fontana et al. | |
| 7,080,685 | B2 | | 7/2006 | Bailey et al. | |
| 7,096,975 | B2 | | 8/2006 | Aronstam et al. | |
| 7,134,489 | B2 | | 11/2006 | Van Riet | |
| 7,159,669 | B2 | | 1/2007 | Bourgoyne et al. | |
| 7,165,610 | B2 | | 1/2007 | Hopper | |
| 7,174,975 | B2 | | 2/2007 | Krueger et al. | |
| 7,185,718 | B2 | | 3/2007 | Gardes | |
| 7,185,719 | B2 | | 3/2007 | Van Riet | |
| 7,237,623 | B2 | | 7/2007 | Hannegan | |
| 7,258,171 | B2 | | 8/2007 | Bourgoyne et al. | |
| 7,264,058 | B2 | | 9/2007 | Fossli | |
| 7,270,185 | B2 | | 9/2007 | Fontana et al. | |
| 7,273,102 | B2 | | 9/2007 | Sheffield | |
| 7,278,496 | B2 | | 10/2007 | Leuchtenberg | |
| 7,350,597 | B2 | | 4/2008 | Reitsma et al. | |
| 7,353,887 | B2 | | 4/2008 | Krueger et al. | |
| 7,367,410 | B2 | | 5/2008 | Sangesland | |
| 7,367,411 | B2 | | 5/2008 | Leuchtenberg | |
| 7,395,878 | B2 | | 7/2008 | Reitsma et al. | |
| 7,487,837 | B2 | | 2/2009 | Bailey et al. | |
| 7,497,266 | B2 | | 3/2009 | Fossli | |
| 7,513,310 | B2 | | 4/2009 | Fossli | |
| 7,562,723 | B2 | | 7/2009 | Reitsma | |
| 7,650,950 | B2 | | 1/2010 | Leuchtenberg | |
| 7,658,228 | B2 | | 2/2010 | Moksvold | |
| 7,677,329 | B2 | | 3/2010 | Stave | |
| 7,699,109 | B2 | | 4/2010 | May et al. | |
| 7,708,064 | B2 | | 5/2010 | Sehsah | |
| 7,721,822 | B2 | | 5/2010 | Krueger et al. | |
| 7,779,903 | B2 | | 8/2010 | Bailey et al. | |
| 7,806,203 | B2 | | 10/2010 | Krueger et al. | |
| 7,836,946 | B2 | | 11/2010 | Bailey et al. | |
| 7,926,560 | B2 | | 4/2011 | Bailey et al. | |
| 7,926,593 | B2 | | 4/2011 | Bailey et al. | |
| 8,033,335 | B2 | | 10/2011 | Orbell et al. | |
| 8,132,630 | B2 | | 3/2012 | Krueger et al. | |
| 2002/0112888 | A1 | | 8/2002 | Leuchtenberg | |
| 2003/0066650 | A1 | | 4/2003 | Fontana et al. | |
| 2003/0098181 | A1 | | 5/2003 | Aronstam et al. | |
| 2004/0206548 | A1 | | 10/2004 | Aronstam et al. | |
| 2006/0065402 | A9 | | 3/2006 | Fontana et al. | |
| 2006/0086538 | A1 | | 4/2006 | Van Riet | |
| 2006/0124318 | A1 | | 6/2006 | Sheffield | |
| 2006/0144622 | A1 | | 7/2006 | Bailey et al. | |
| 2007/0012457 | A1 | | 1/2007 | Curtis et al. | |
| 2007/0068704 | A1 | | 3/2007 | Krueger et al. | |
| 2007/0240875 | A1 | | 10/2007 | Van Riet | |
| 2008/0251257 | A1 | | 10/2008 | Leuchtenberg | |
| 2009/0057021 | A1 | | 3/2009 | Williams | |
| 2009/0101351 | A1 | | 4/2009 | Hannegan | |
| 2009/0211239 | A1 | | 8/2009 | Askeland | |
| 2010/0006297 | A1 | | 1/2010 | Stave | |
| 2010/0018715 | A1 | | 1/2010 | Orbell et al. | |
| 2010/0175882 | A1 | | 7/2010 | Bailey et al. | |
| 2011/0024195 | A1 | | 2/2011 | Hoyer et al. | |
| 2011/0108282 | A1 | | 5/2011 | Kozicz et al. | |
| 2011/0127040 | A1 | | 6/2011 | Humphreys | |
| 2011/0168392 | A1 | | 7/2011 | Bailey et al. | |

FOREIGN PATENT DOCUMENTS

| | | | |
|---|---|---|---|
| EP | 1488073 | B1 | 8/2006 |
| EP | 1664478 | B1 | 12/2006 |
| EP | 2053196 | A1 | 10/2007 |
| EP | 2050924 | A2 | 4/2009 |
| EP | 1356186 | B1 | 6/2009 |
| EP | 2208855 | A2 | 1/2010 |
| EP | 2216498 | A2 | 8/2010 |
| EP | 2378056 | A2 | 10/2011 |
| GB | 2478119 | A | 8/2011 |
| WO | 9942696 | A1 | 8/1999 |
| WO | 0183941 | A1 | 11/2001 |
| WO | 0190528 | A1 | 11/2001 |
| WO | 0244518 | A1 | 6/2002 |
| WO | 03015336 | A1 | 2/2003 |
| WO | 03025334 | A8 | 3/2003 |
| WO | 2004005667 | A1 | 1/2004 |
| WO | 03071091 | A9 | 6/2004 |

(56) References Cited

FOREIGN PATENT DOCUMENTS

| | | | |
|---|---|---|---|
| WO | 2004074627 | A1 | 9/2004 |
| WO | 2004085788 | A3 | 11/2004 |
| WO | 2005001237 | A1 | 1/2005 |
| WO | 2005017308 | A1 | 2/2005 |
| WO | 2006029379 | A1 | 3/2006 |
| WO | 2006031119 | A1 | 3/2006 |
| WO | 2006099362 | A1 | 9/2006 |
| WO | 2006118920 | A3 | 11/2006 |
| WO | 2006138565 | A1 | 12/2006 |
| WO | 2007008085 | A1 | 1/2007 |
| WO | 2007016000 | A1 | 2/2007 |
| WO | 2007030017 | A1 | 3/2007 |
| WO | 2007081711 | A3 | 7/2007 |
| WO | 2007112292 | A3 | 10/2007 |
| WO | 2007124330 | A3 | 11/2007 |
| WO | 2007126833 | A1 | 11/2007 |
| WO | 2008120025 | A2 | 10/2008 |
| WO | 2008133523 | A1 | 11/2008 |
| WO | 2008134266 | A1 | 11/2008 |
| WO | 2008151128 | A1 | 12/2008 |
| WO | 2008156376 | A9 | 12/2008 |
| WO | 2009017418 | A1 | 2/2009 |
| WO | 2009018448 | A1 | 2/2009 |
| WO | 2009058706 | A1 | 5/2009 |
| WO | 2009086442 | A2 | 7/2009 |

OTHER PUBLICATIONS

International Search Report with Written Opinion issued Sep. 28, 2011 for PCT Patent Application No. PCT/US11/029116, 9 pages.
International Search Report with Written Opinion issued Sep. 29, 2011 for PCT Patent Application No. PCT/US11/028384, 11 pages.
International Search Report with Written Opinion issued Aug. 19, 2011 for PCT Patent Application No. PCT/US10/057539, 12 pages.
International Preliminary Report on Patentability issued Oct. 4, 2012 for US PCT Patent Application No. PCT/US2011/029116, 6 pages.
Examination Report issued Feb. 10, 2014 for Australian Patent Application No. 2011329491, 3 pages.
Office Action issued Feb. 19, 2014 for Chinese Patent Application No. 201180023939.4, 9 pages.
English translation of Office Action issued Feb. 19, 2014 for Chinese Patent Application No. 201180023939.4, 9 pages.
Weatherford; "Williams Model IP 1000", brochure # 325.02, dated 2002, 2 pages.
Smith Services; "Hold 2500 Rotating Control Device", brochure SS-04-0055.10M, dated 2004, 4 pages.
Weatherford; "DDV Downhole Deployment Valve", Informational Article 335.01, dated 2005-2010, 4 pages.
Cameron; "Deepwater Collet Connector", web page, dated 2006, 1 page.
Weatherford; "Model 7000", Technical data sheet, dated Nov. 2006, 2 pages.
Weatherford; "Model 7100" Technical data sheet, dated Nov. 2006, 2 pages.
Weatherford; "Model 7800 Rotating Control Device" Technical data sheet, dated Nov. 2006, 2 pages.
Weatherford; "Model 8000" Technical data sheet, dated Nov. 2006, 2 pages.
Weatherford; "Model 9000" Technical data sheet, dated Nov. 2006, 2 pages.
Weatherford; "Model IP 1000" Technical data sheet, dated Nov. 2006, 2 pages.
Weatherford; "Managed Pressure Drilling, Downhole Deployment Valve Enable Drilling of Big-Bore Gas Wells in Sumatra", Informational Article 2831.03, dated 2007-2010, 2 pages.
Weatherford; "Weatherford Model 7800 Rotating Control Device", 4593.00, dated 2007, 5 pages.
Vetcogray; "H-4 Subsea Connectors", GE Oil & Gas article, dated Jan. 9, 2008, 7 pages.
Don Hannegan; "Offshore drilling hazard mitigation: Controlled pressure drilling redefines what is drillable", Drilling Contractor magazine, dated Jan./Feb. 2009, 4 pages.
Smith Services; "Marine Riser RCD", company presentation, dated Jul. 2009, 18 pages.
Weatherford; "Model 7875 Rotating Control Device", 4594.01, dated 2010, 4 pages.
Oceaneering; "Remotely Operated Connectors", Grayloc Products webpage, received Feb. 18, 2010, 2 pages.
Halliburton Energy Services, Inc.; "RCD 5000 Rotating Control Device", H05284, dated Feb. 2010, 8 pages.
Vector Group; "Optima Subsea Connector", company web page, dated 2010, 2 pages.
Halliburton Energy Services, Inc.; "RCD 1000 Rotating Control Device", H07903, dated Aug. 2010, 2 pages.
Diamond Rotating Heads, Inc.; Product information, company brochure, received Dec. 3, 2010, 4 pages.
Diamond Rotating Heads, Inc.; Diamond Model 8000/9000, Technical data sheet, received Dec. 3, 2010, 2 pages.

* cited by examiner

FIG.5
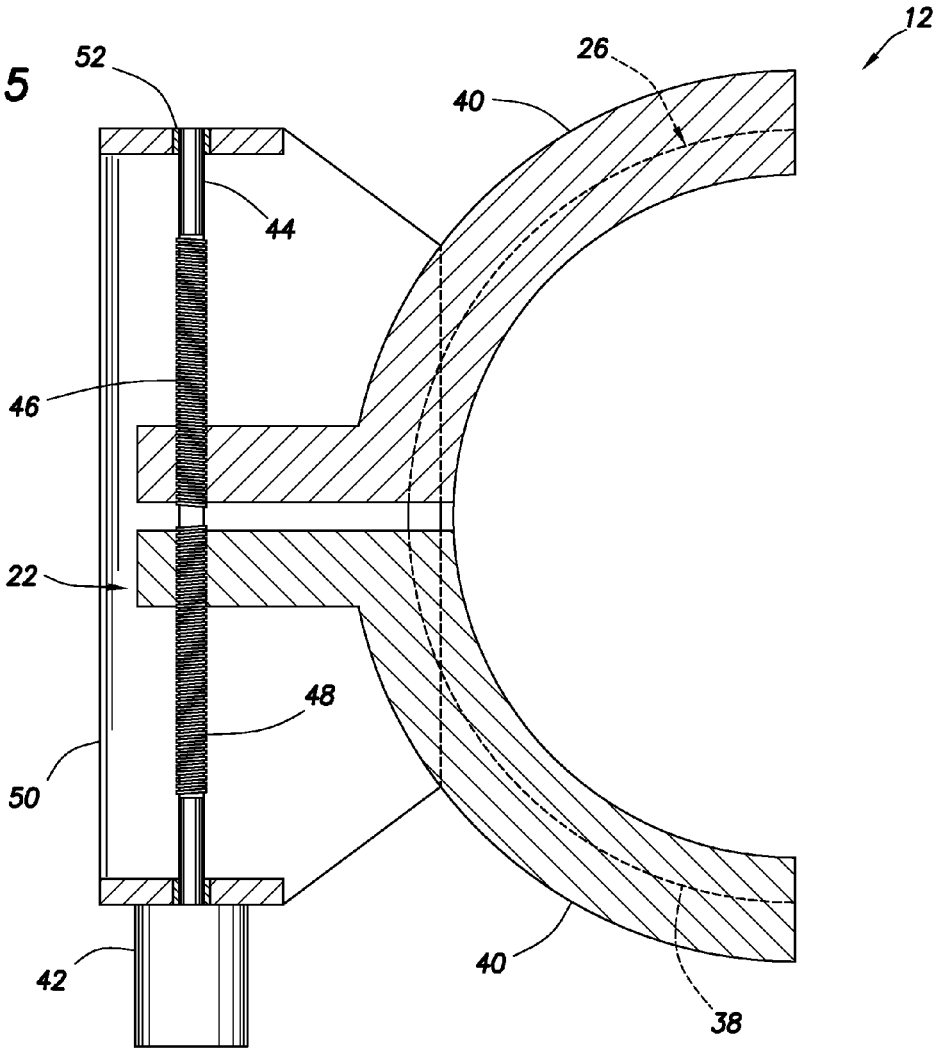
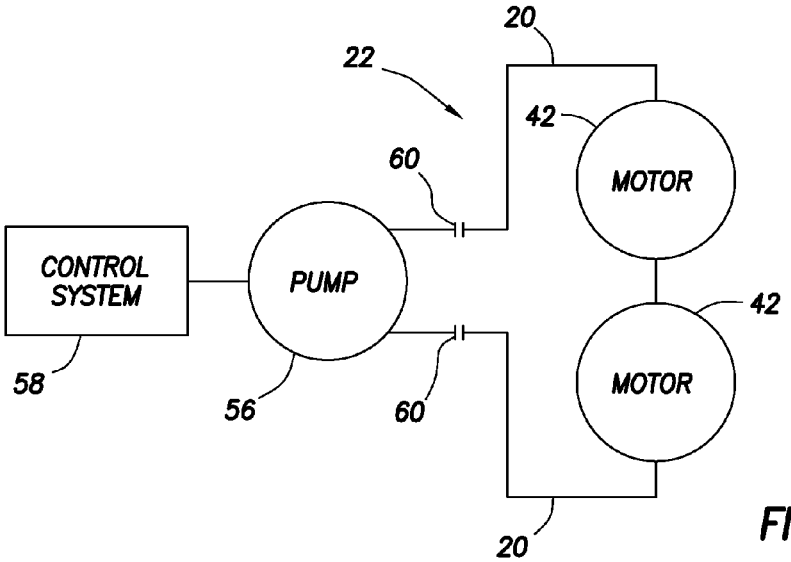
FIG.6

REMOTE OPERATION OF A ROTATING CONTROL DEVICE BEARING CLAMP AND SAFETY LATCH

CROSS-REFERENCE TO RELATED APPLICATIONS

This application claims the benefit under 35 USC §119 of the filing date of International Application Serial No. PCT/US11/28384, filed 14 Mar. 2011, which claims priority to International Application Serial No. PCT/US10/57539, filed 20 Nov. 2010. The entire disclosures of these prior applications are incorporated herein by this reference.

BACKGROUND

The present disclosure relates generally to equipment utilized and operations performed in conjunction with a subterranean well and, in an embodiment described herein, more particularly provides for remote operation of a rotating control device bearing clamp and safety latch.

A conventional rotating control device may require human activity in close proximity thereto, in order to maintain or replace bearings, seals, etc. of the rotating control device. It can be hazardous for a human to be in close proximity to a rotating control device, for example, if the rotating control device is used with a floating rig.

Therefore, it will be appreciated that improvements are needed in the art of constructing rotating control devices. These improvements would be useful whether the rotating control devices are used with offshore or land-based rigs.

BRIEF DESCRIPTION OF THE DRAWINGS

FIG. 5 is a representative partially cross-sectional top view of the clamp device in the clamped arrangement.

FIG. 6 is a representative fluid circuit diagram for operation of the clamp device.

DETAILED DESCRIPTION

Figure 1:
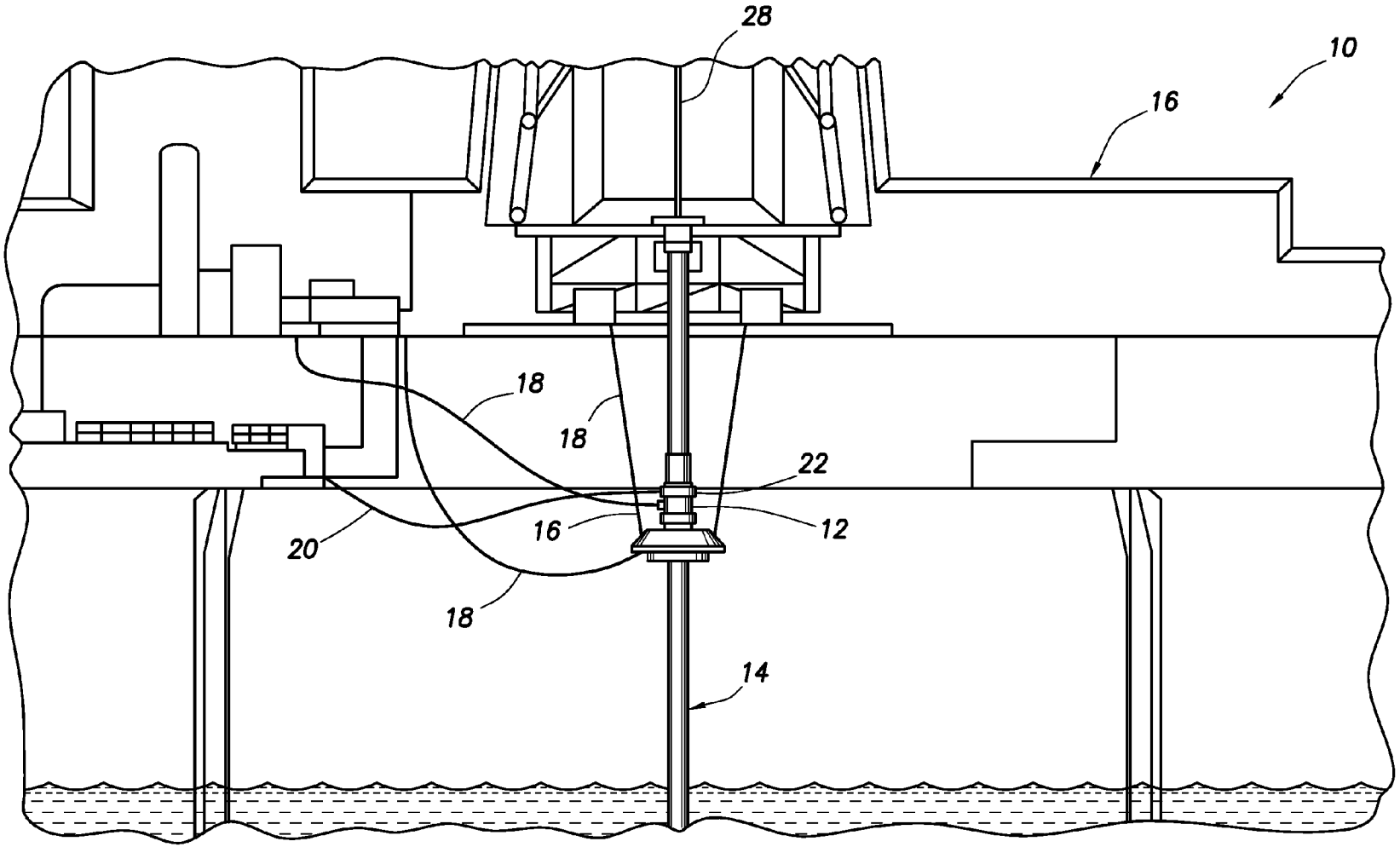
FIG. 1 is a representative view of a well system and associated method which embody principles of the present disclosure.

Representatively illustrated in FIG. 1 is a well system 10 and associated method which can embody principles of the present disclosure. In the system 10, a rotating control device (RCD) 12 is connected at an upper end of a riser assembly 14. The riser assembly 14 is suspended from a floating rig 16.

It will be readily appreciated by those skilled in the art that the area (known as the "moon pool") surrounding the top of the riser assembly 14 is a relatively hazardous area. For example, the rig 16 may heave due to wave action, multiple lines and cables 18 may be swinging about, etc. Therefore, it is desirable to reduce or eliminate any human activity in this area.

Seals and bearings in a rotating control device (such as the RCD 12) may need to be maintained or replaced, and so one important feature of the RCD depicted in FIG. 1 is that its clamp device 22 can be unclamped and clamped without requiring human activity in the moon pool area of the rig 16. Instead, fluid pressure lines 20 are used to apply pressure to the clamp device 22, in order to clamp and unclamp the device (as described more fully below).

Figure 2:
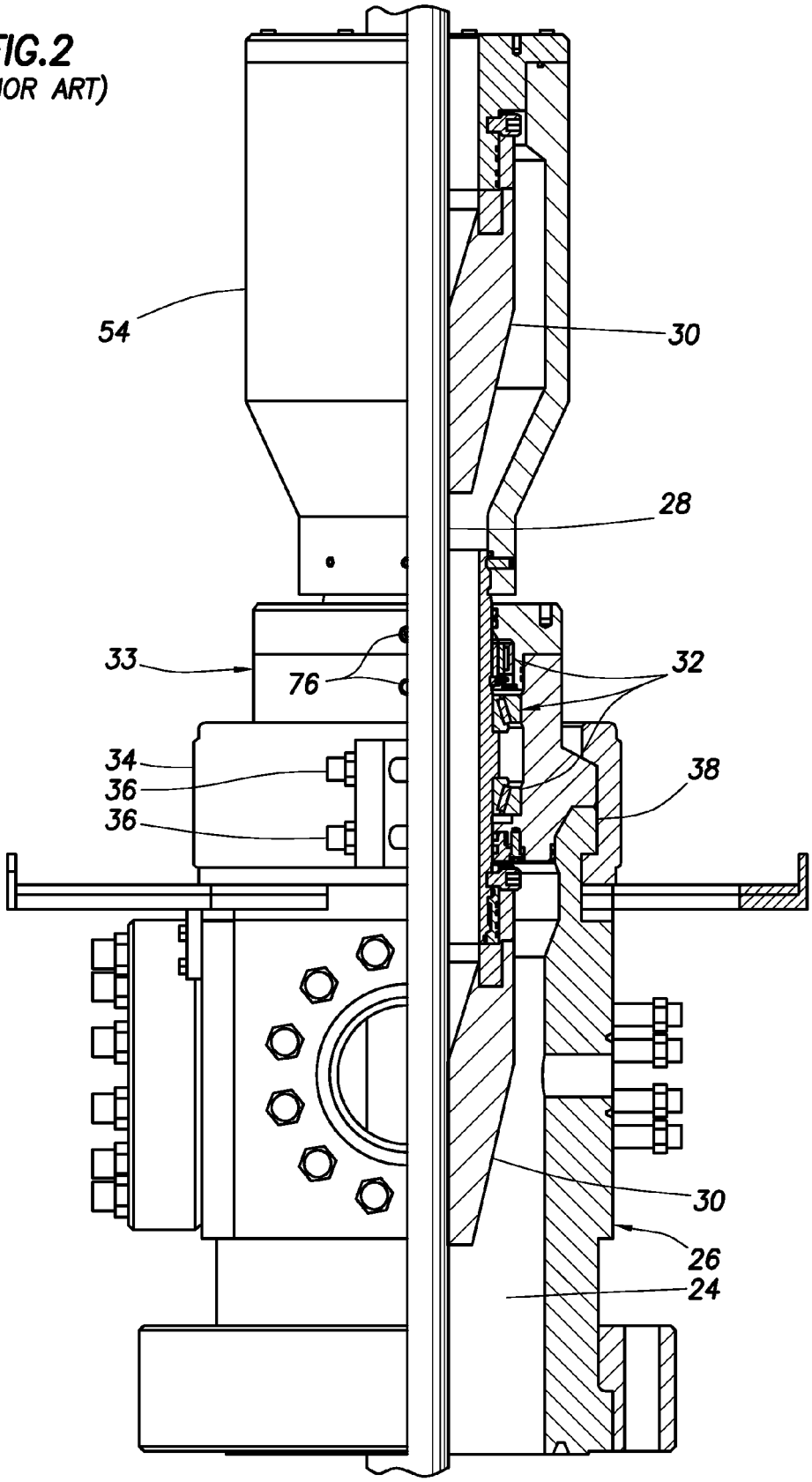
FIG.2 (PRIOR ART)
FIG. 2 is a partially cross-sectional view of a prior art rotating control device.

Referring additionally now to FIG. 2, a prior art rotating control device is representatively illustrated. The rotating control device depicted in FIG. 2 is used as an example of a type of rotating control device which can be improved using the principles of this disclosure. However, it should be clearly understood that various other types of rotating control devices can incorporate the principles of this disclosure, as well.

Rotating control devices are also known by the terms "rotating control head," "rotating blowout preventer," "rotating diverter" and "RCD." A rotating control device is used to seal off an annulus 24 formed radially between a body 26 of the rotating control device and a tubular string 28 (such as a drill string) positioned within the body. The annulus 24 is sealed off by the rotating control device, even while the tubular string 28 rotates therein.

For this purpose, the rotating control device includes one or more annular seals 30. If multiple seals 30 are used, the rotating control device may include an upper seal housing 54. To permit the seals 30 to rotate as the tubular string 28 rotates, a bearing assembly 32 is provided in a bearing housing assembly 33.

A clamp 34 releasably secures the bearing housing assembly 33 (with the bearing assembly 32 and seals 30 therein) to the body 26, so that the bearing assembly and seals can be removed from the body for maintenance or replacement. However, in the prior art configuration of FIG. 2, threaded bolts 36 are used to secure ends of the clamp 34, and so human activity in the area adjacent the rotating control device (e.g., in the moon pool) is needed to unbolt the ends of the clamp whenever the bearing assembly 32 and seals 30 are to be removed from the body 26. This limits the acceptability of the FIG. 2 rotating control device for use with land rigs, floating rigs, other types of offshore rigs, etc.

Figure 3:
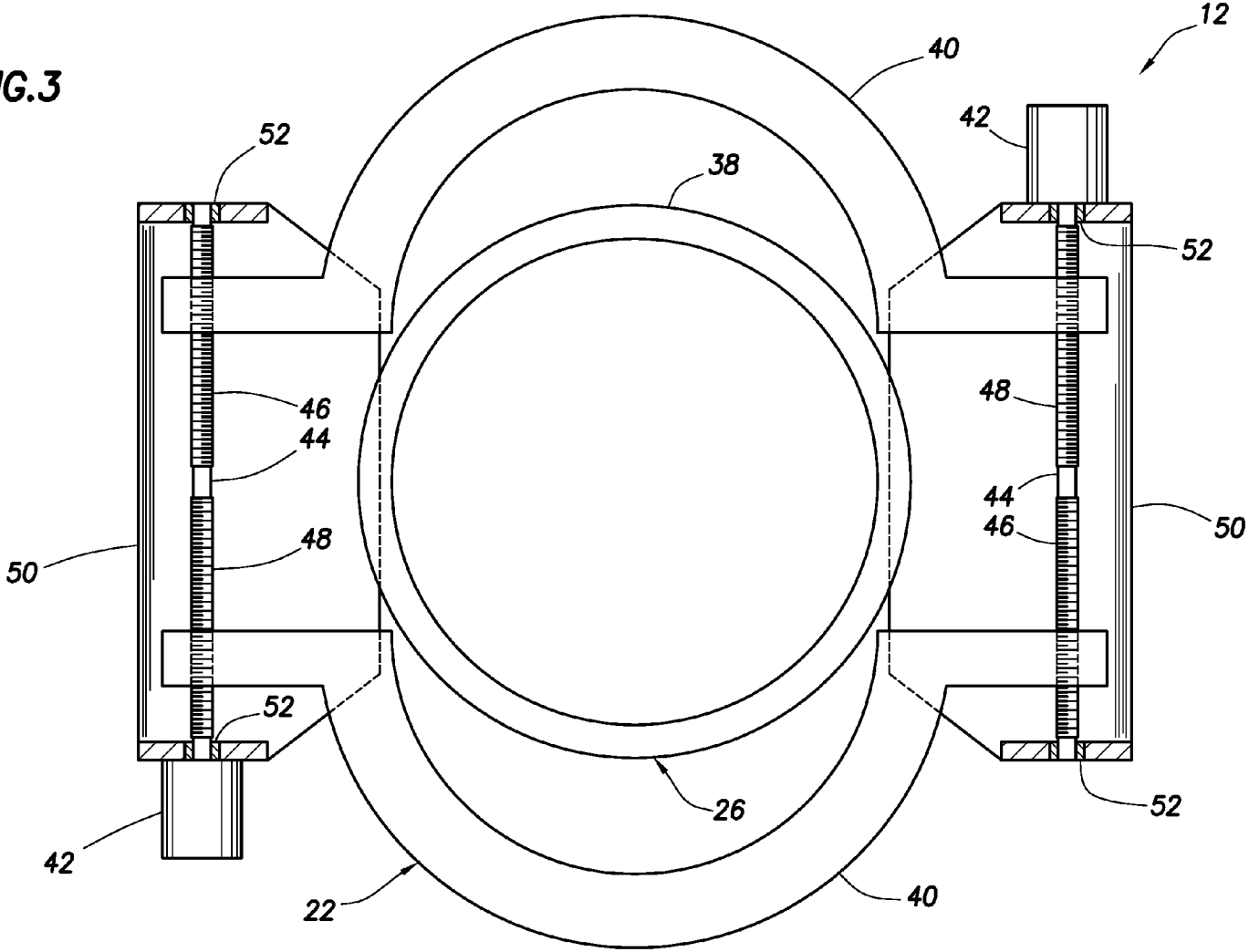
FIG. 3 is a representative partially cross-sectional top view of an improvement to the rotating control device, the improvement comprising a clamp device and embodying principles of this disclosure, and the clamp device being shown in an unclamped arrangement.

Referring additionally now to FIG. 3, the improved RCD 12 having the remotely operable clamp device 22 is representatively illustrated. For illustrative clarity, only an upper, outwardly projecting lip 38 of the body 26 is shown, since the lip is the portion of the body which is engaged by the clamp device 22 in this example.

An unclamped configuration of the clamp device 22 is depicted in FIG. 3. In this configuration, two clamp sections 40 have been displaced outward, thereby permitting removal of the housing assembly 33, bearing assembly 32 and seals 30 from the body 26. Clamp sections 40 could be unitary or divided into sections or segments.

The clamp sections 40 are displaced outward (in opposite directions, away from each other) by two fluid motors 42. The motors 42 rotate respective threaded members 44, which are threaded into each of the clamp sections 40.

Note that each threaded member 44 has two oppositely threaded portions 46, 48 (e.g., with one portion being right-hand threaded, and the other portion being left-hand threaded). Thus, as a threaded member 44 rotates, it will cause the clamp sections 40 to displace in opposite directions (toward or away from each other, depending on the direction of rotation of the threaded member).

The motors 42, ends of the clamp sections 40 and ends of the threaded members 44 are supported by bracket-type supports 50. The ends of the threaded members 44 preferably are rotationally mounted to the supports 50 using, for example, bushings 52. The motors 42 are preferably rigidly mounted to the supports 50, for example, using fasteners (not shown).

Although two each of the clamp sections 40, motors 42 and threaded members 44 are depicted in FIGS. 2 & 3, it should be clearly understood that any number (including one) of these components may be used in keeping with the principles of this disclosure.

Figure 4:
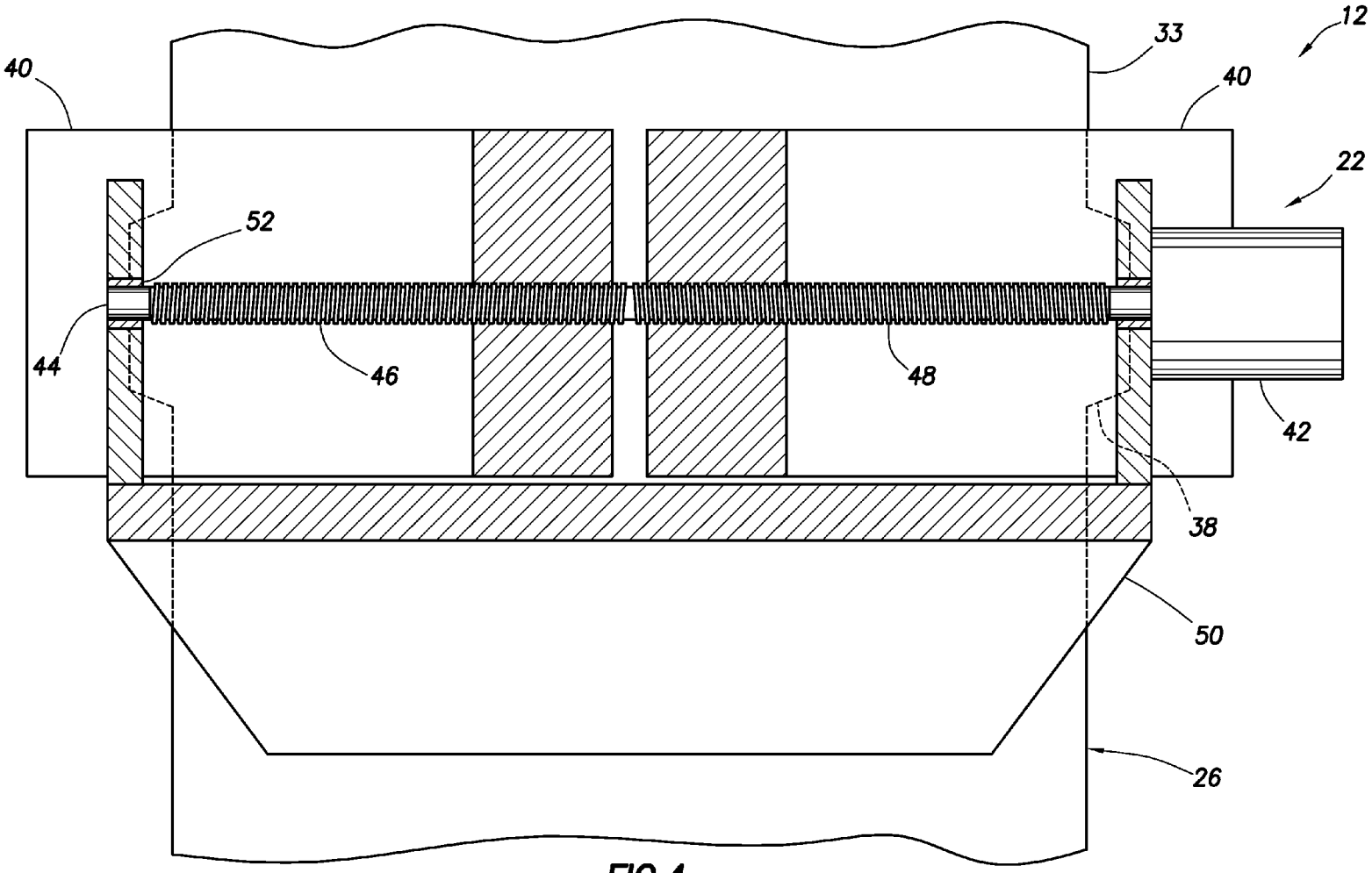
FIG. 4 is a representative partially cross-sectional side view of the clamp device in a clamped arrangement.

Referring additionally now to FIG. 4, an enlarged scale side, partially cross-sectional view of the clamp device 22 on the RCD 12 is representatively illustrated. In the FIG. 4 illustration, the clamp device 22 is in a clamped configuration.

In this view it may be seen that the bearing housing assembly 33 and an upper seal housing 54 (see FIG. 2) of the RCD 12 are securely clamped to the body 26, due to displacement of the clamp sections 40 toward each other. This displacement is caused by rotation of the threaded member 44 by the motor 42, and the threaded engagement of the oppositely threaded portions 46, 48 with the ends of the clamp sections 40.

Referring additionally now to FIG. 5, a top, partially cross-sectional view of the clamp device 22 in the closed configuration is representatively illustrated. Although only one lateral side of the clamp device 22 is shown in FIG. 5, it will be appreciated that the other side is preferably identical to the illustrated side.

Note that the motors 42 are preferably fluid motors, that is, motors which are operated in response to fluid pressure applied thereto. For example, the motors 42 could be hydraulic or pneumatic motors. However, other types of motors (such as electric motors) could be used, if desired.

Referring additionally now to FIG. 6, a schematic fluid circuit diagram for operation of the clamp device 22 is representatively illustrated. In this diagram, it may be seen that the motors 42 are connected via the lines 20 to a pressure source 56 (such as a pump, an accumulator, a pressurized gas container, etc.).

Pressure is delivered to the motors 42 from the pressure source 56 under control of a control system 58. For example, when it is desired to unclamp the clamp device 22, the control system 58 may cause the pressure source 56 to deliver a pressurized fluid flow to one of the lines 20 (with fluid being returned via the other of the lines), in order to cause the motors 42 to rotate the threaded members 44 in one direction. When it is desired to clamp the clamp device 22, the control system 58 may cause the pressure source 56 to deliver a pressurized fluid flow to another of the lines 20 (with fluid being returned via the first line), in order to cause the motors 42 to rotate the threaded members 44 in an opposite direction.

Connectors 60 may be provided for connecting the lines 20 to the pressure source 56, which is preferably positioned at a remote location on the rig 16. The motors 42 and/or threaded members 44 are preferably designed so that the threaded members will not rotate if the connectors 60 are disconnected, or if pressurized fluid is not flowed through the lines.

For example, a pitch of the threads on the threaded members 44 could be sufficiently fine, so that any force applied from the clamp sections 40 to the threaded members will not cause the threaded members to rotate. In this manner, the loss of a capability to apply fluid pressure to the motors 42 will not result in any danger that the clamp device 22 will become unclamped, even if the body 26 is internally pressurized.

Note that the motors 42 are preferably connected to the lines 20 in series, so that they operate simultaneously. In this manner, the ends of the clamp sections 40 will be displaced the same distance, at the same time, in equal but opposite directions, by the motors 42.

Although two lines 20 are depicted in FIG. 6 for flowing fluid to and from the pressure source 56 and motors 42, any number of lines (including one) may be used in keeping with the principles of this disclosure. If pressurized gas is used as the fluid, it may not be necessary to flow the gas from the motors 42 back to the pressure source 56 (for example, the gas could be exhausted to atmosphere).

Figure 7:
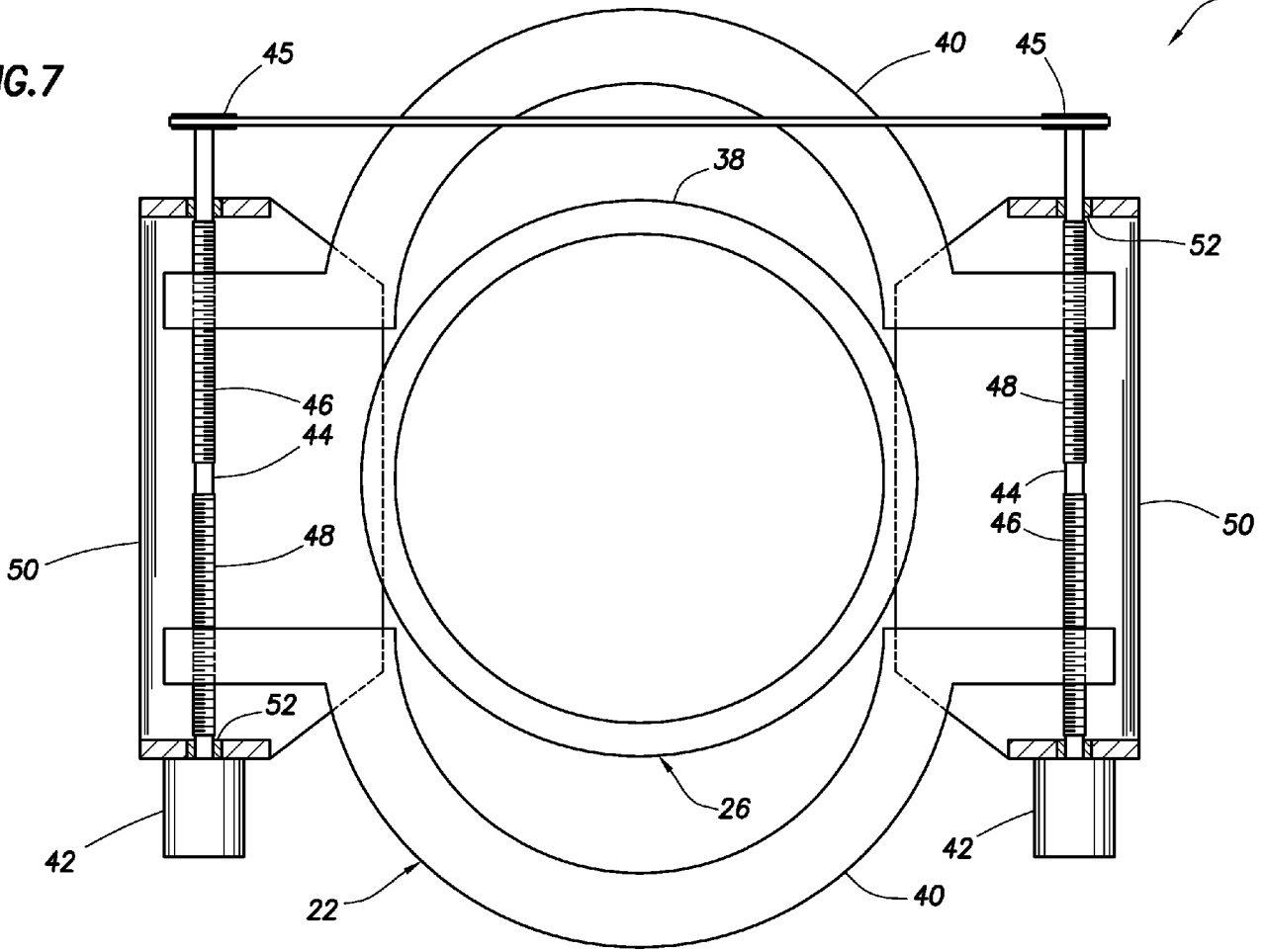
FIG. 7 is a representative partially cross-sectional view of another configuration of the clamp device.

Referring additionally now to FIG. 7, another configuration of the clamp device 22 is representatively illustrated. The configuration of FIG. 7 is similar in many respects to the configuration of FIG. 3.

However, the threaded members 44 in the configuration of FIG. 7 are constrained to rotate together at the same speed by devices 45, such as sprockets and a chain, pulleys and a belt, gears, etc. This ensures that the clamp sections 40 are displaced the same distance at the same time on both sides of the body 26.

Two of the motors 42 are depicted in FIG. 7 for rotating the threaded members 44. However, only one motor 42 may be used, if desired.

Figure 8A:
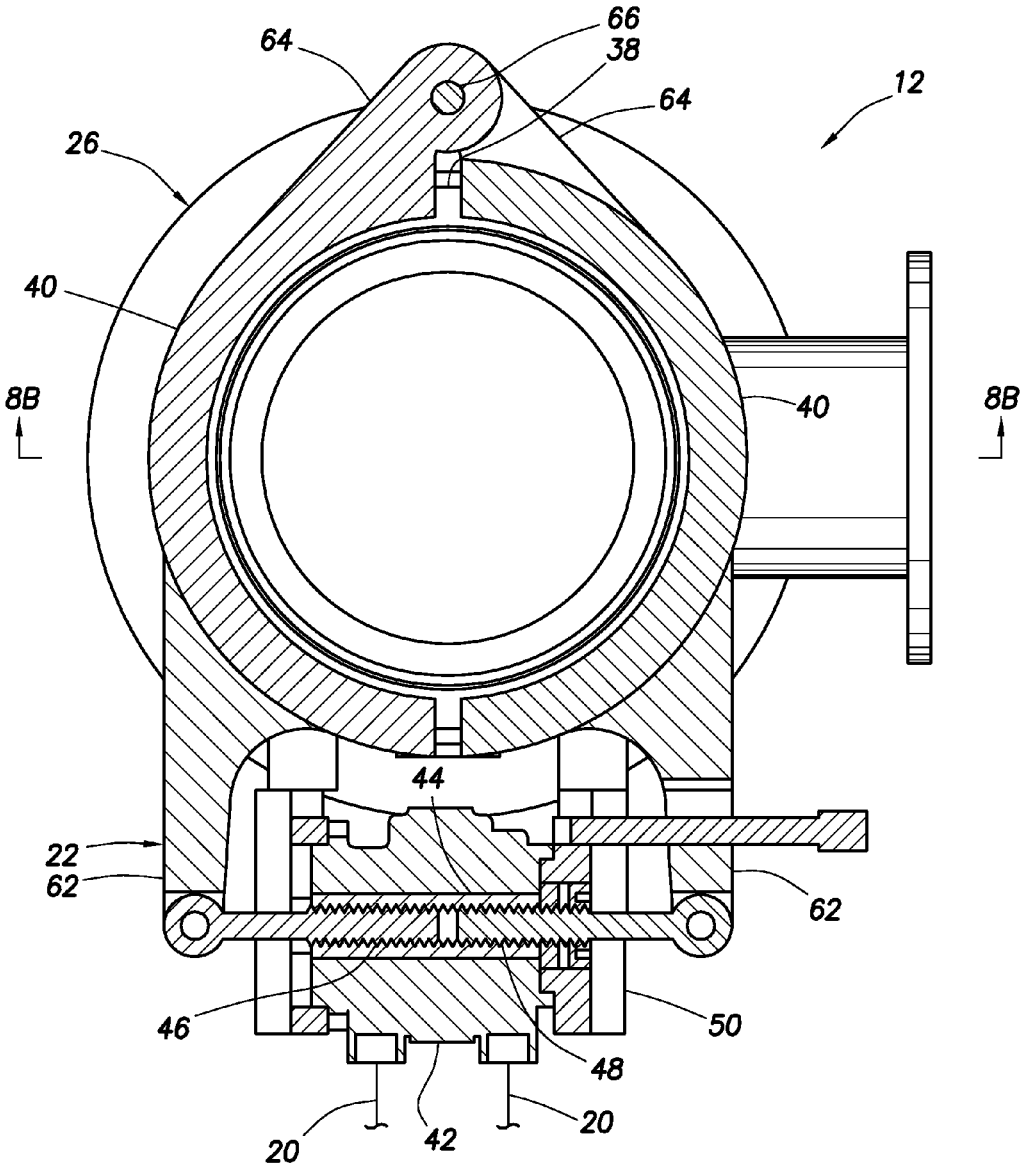
FIGS. 8A & B are representative partially cross-sectional views of another configuration of the clamp device.
Figure 8B:
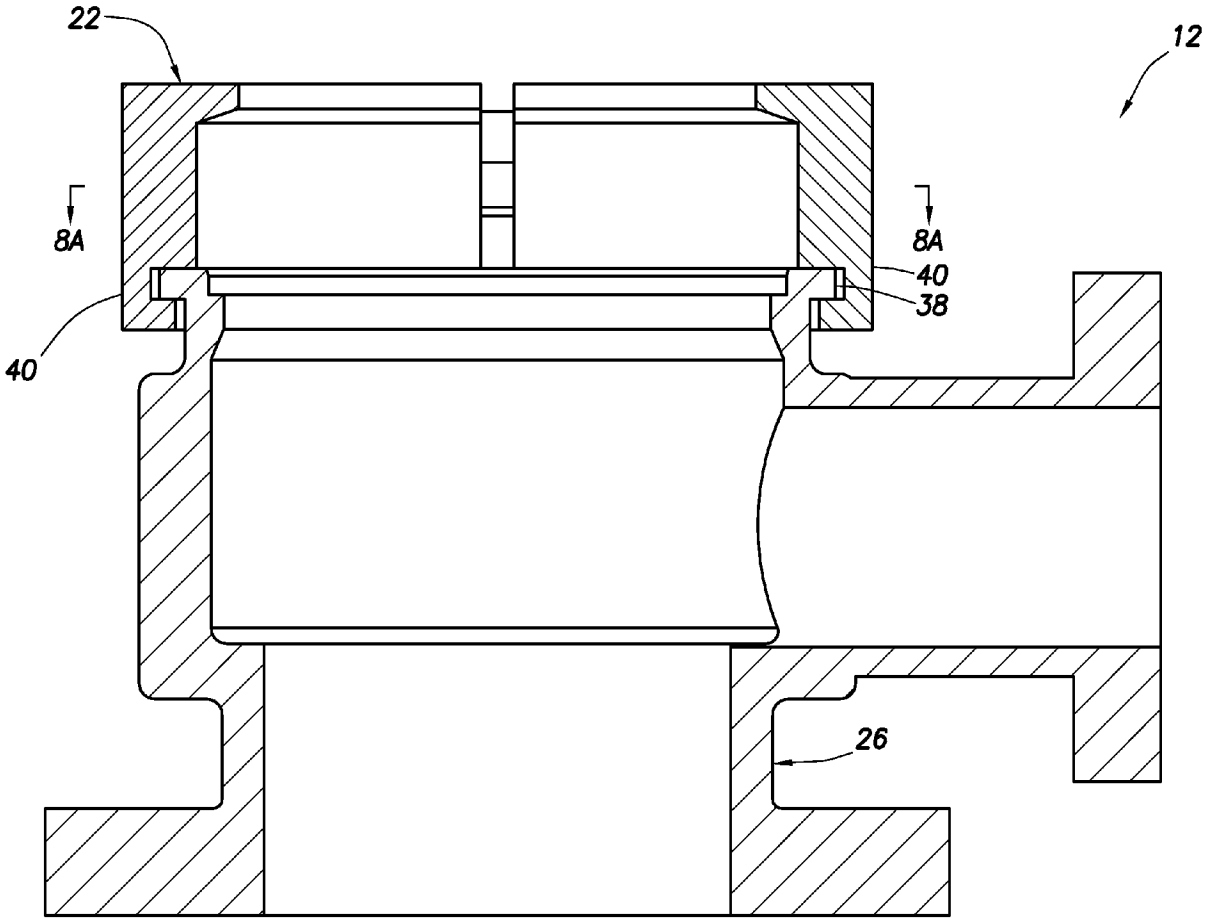

Referring additionally now to FIGS. 8A & B, another configuration of the clamp device 22 is representatively illustrated. In this configuration, the clamp device 22 includes a single fluid motor 42 positioned between ends 62 of the clamp sections 40. Opposite ends 64 of the clamp sections 40 are pivotably mounted to the body 26 at a pivot 66, which has an axis of rotation 91.

Unlike the previously described example, the motor 42 in the example of FIGS. 8A & B rotates an internally threaded member 44. Externally threaded portions 46, 48 are pivotably mounted to the ends 62 of the clamp sections 40. When the motor 42 rotates the threaded member 44, the threaded portions 46, 48 (and, thus, the ends 62 of the clamp sections 40) displace either toward each other, or away from each other, depending on the direction of rotation of the threaded member 44.

The clamp device 22 is depicted in its clamped arrangement in FIGS. 8A & B. It will be appreciated that, if the threaded member 44 is rotated by the motor 42 to displace the ends 62 of the clamp sections 40 away from each other, the clamp sections will pivot away from each other (on the pivot 66), thereby allowing removal or installation of the bearing housing assembly 33 onto the body 26.

The motor 42 is preferably slidably mounted to the body 26 so that, when the clamp sections 40 are displaced away from each other, the motor can move laterally inward toward the body. When the clamp sections 40 are displaced toward each other, the motor 42 can move laterally outward away from the body 26.

Figure 9A:
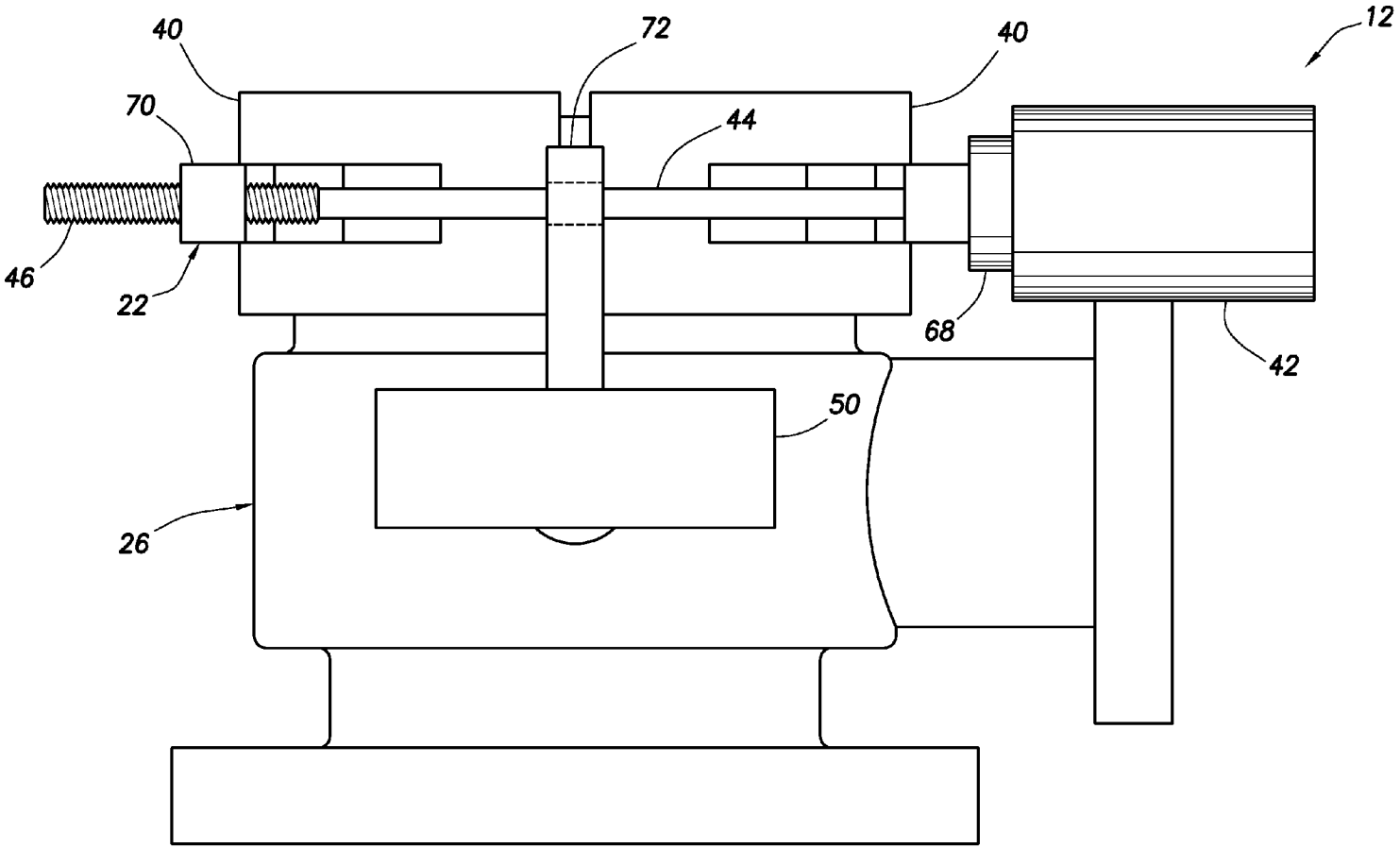
FIGS. 9A & B are representative partially cross-sectional views of another configuration of the clamp device.
Figure 9B:
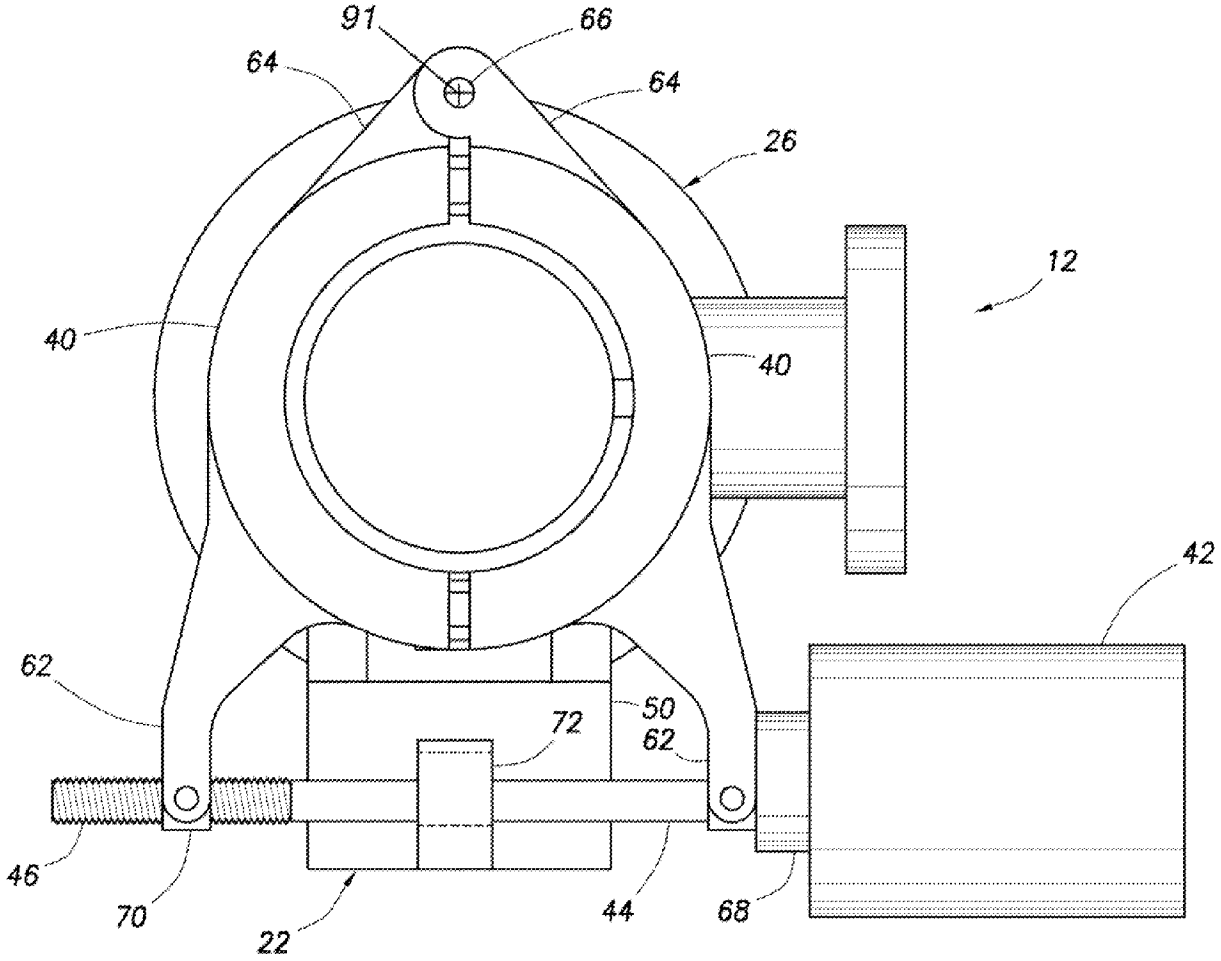

Referring additionally now to FIGS. 9A & B, another configuration of the clamp device 22 is representatively illustrated. In this configuration, the motor 42 is preferably a pneumatic motor, and is provided with a gearbox 68 for increasing a torque output of the motor.

The motor 42 is pivotably mounted to one of the clamp section ends 62. The threaded portion 46 of the threaded member 44 is received in an internally threaded member 70 pivotably mounted to the other clamp section end 62. A central stabilizer 72 is mounted to the support 50 for supporting the threaded member 44.

When the motor 42 rotates the threaded member 44, the ends 62 of the clamp sections 40 displace either toward or away from each other, with the clamp sections pivoting about the pivot 66. As with the other configurations described above, the motor 42 and/or threaded member 44 are preferably designed (e.g., with sufficiently fine pitch threads, by providing a brake for the motor, etc.) so that the loss of a capability to apply fluid pressure to the motor will not result in any danger that the clamp device 22 will become unclamped, even if the body 26 is internally pressurized.

Figure 10:
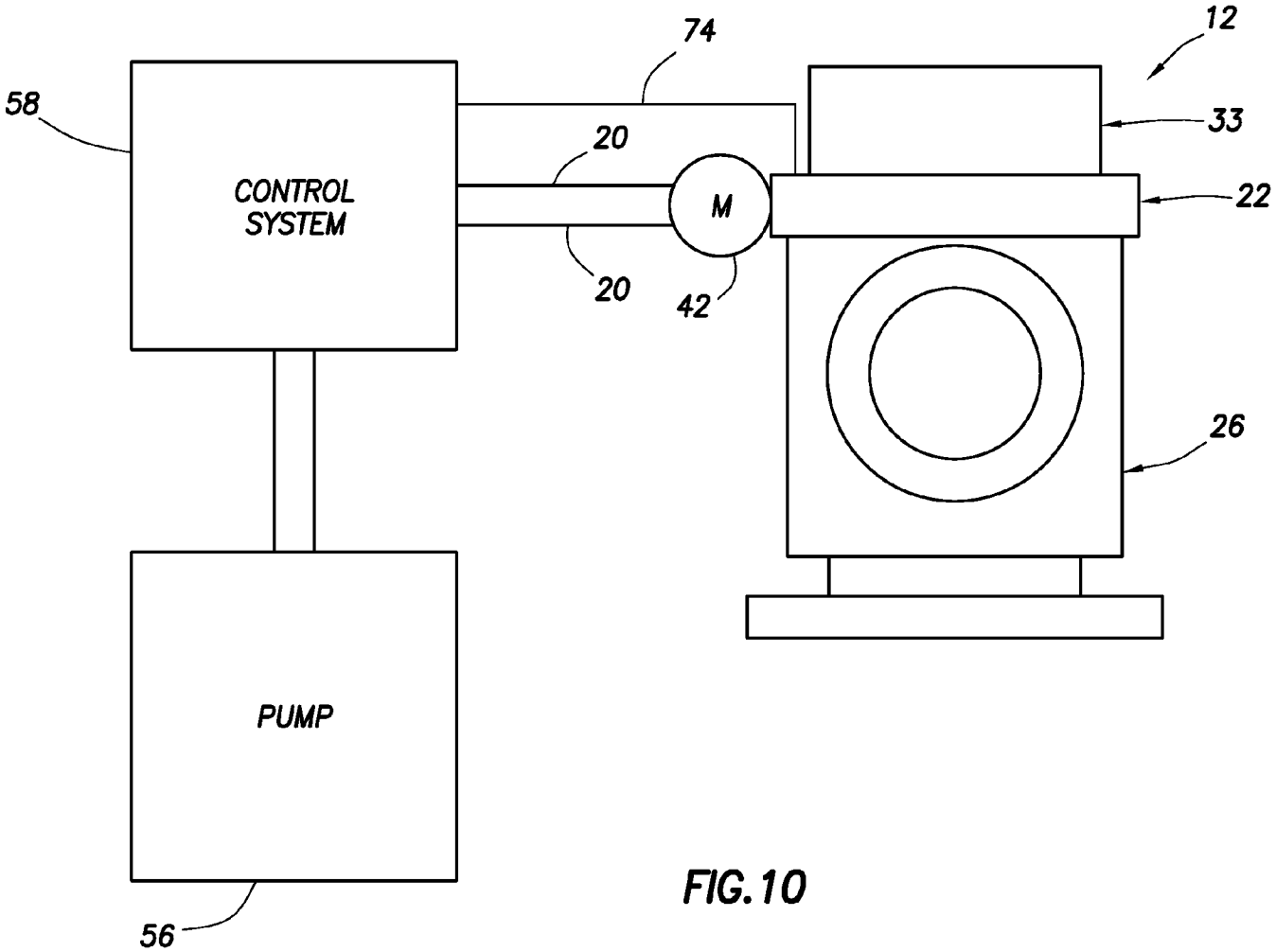
FIG. 10 is another representative fluid circuit diagram for operation of the clamp device.

Referring additionally now to FIG. 10, another fluid circuit diagram for the RCD 12 is representatively illustrated. This fluid circuit diagram differs from the one depicted in FIG. 6, at least in that the control system 58 is interposed between the pressure source 56 and the motor 42. The control system 58 includes valves, etc., which selectively communicate pressure between the pressure source 56 and appropriate ones of the lines 20 to operate the motor 42.

In addition, one or more lines 74 may be used to transmit lubrication to the bearing assembly 32. One or more ports 76 (see FIG. 2) can be used for connecting the lines 74 to the interior of the housing assembly 33.

One advantage of the FIG. 10 fluid circuit is that the same pressure source 56 may be used to operate the clamp device 22, and to deliver lubricant to the bearing assembly 32. The control system 58 can direct lubricant to the bearing assembly 32 while the tubular string 28 is rotating within the RCD 12, and the control system can direct fluid pressure to the motor (s) 42 when needed to operate the clamp device 22.

Figure 11:
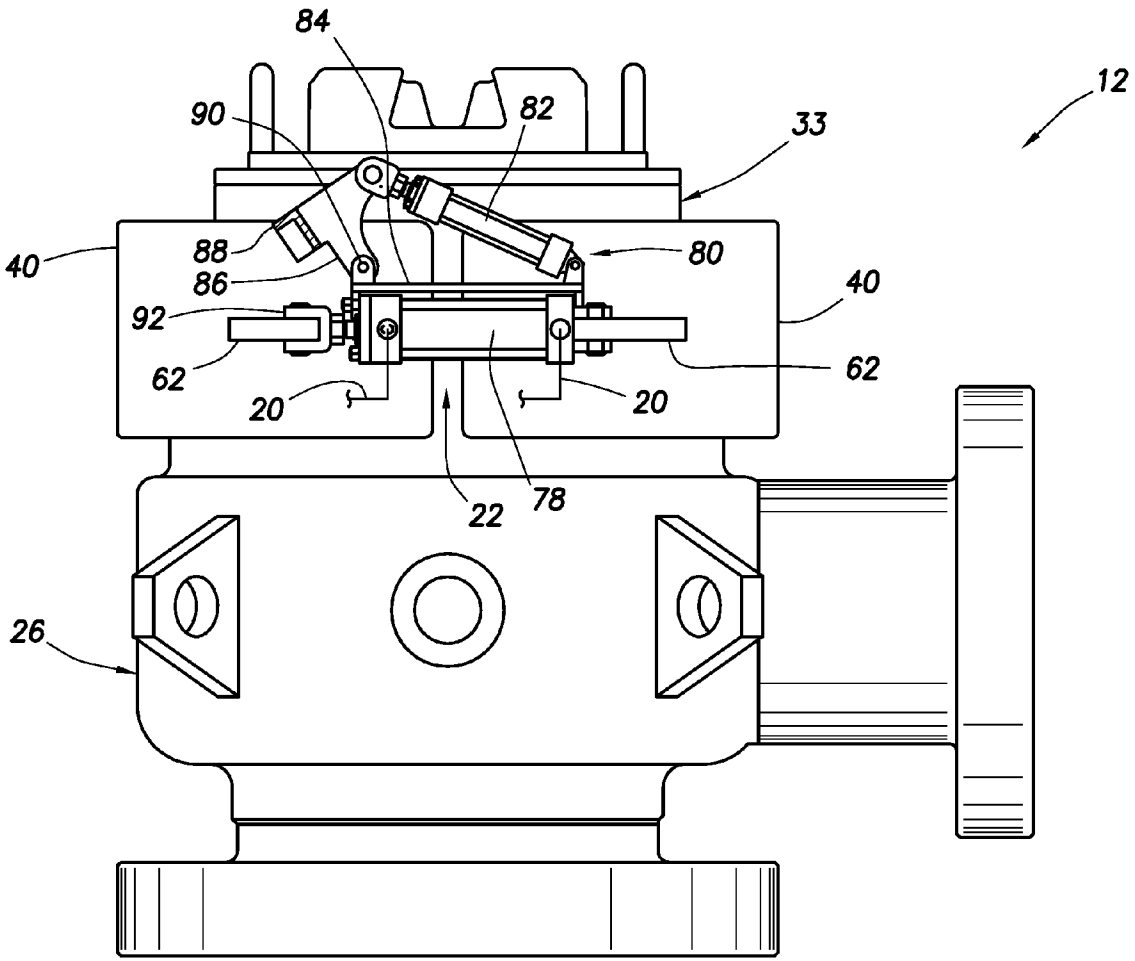
FIGS. 11 & 12 are representative side views of another configuration of the rotating control device, a safety latch being depicted unlatched in FIG. 11 and latched in FIG. 12.
Figure 12:
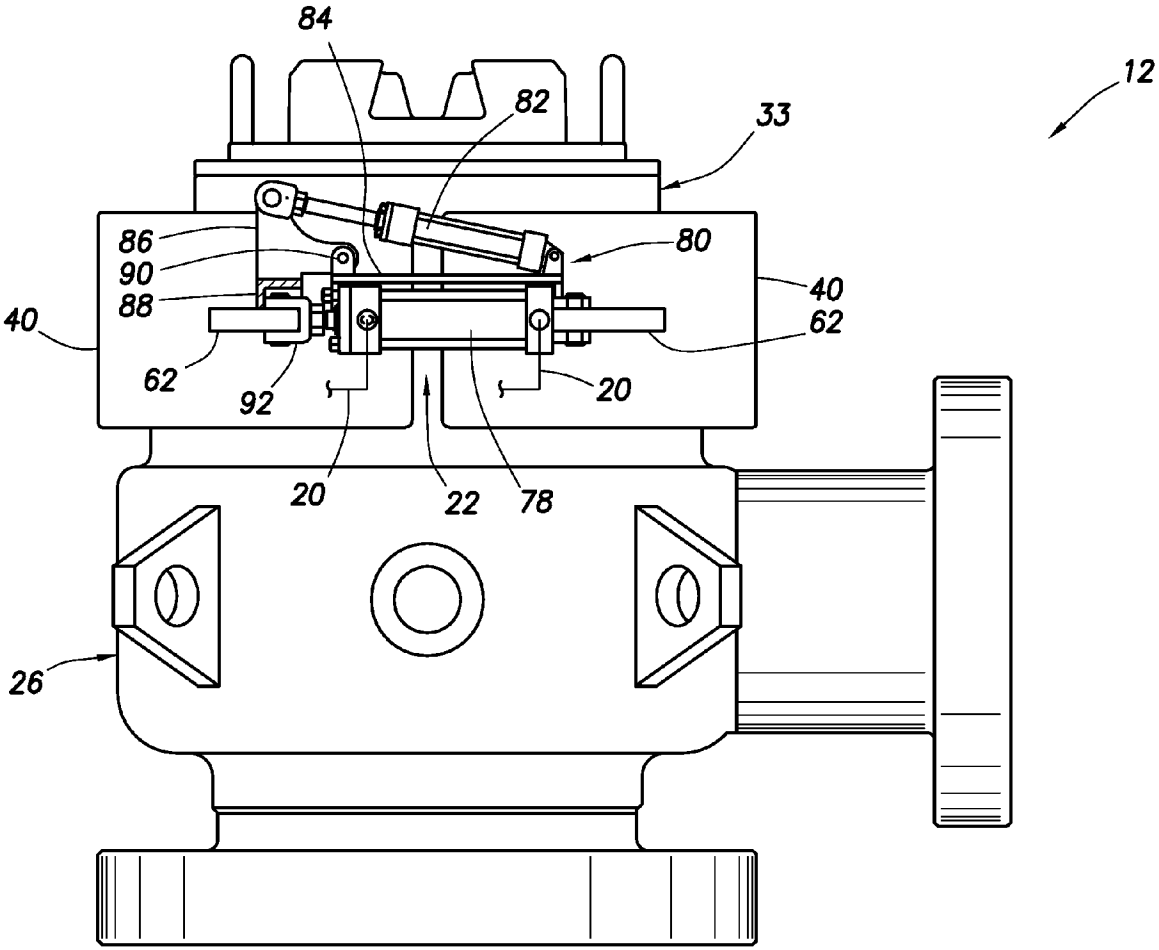

Referring additionally now to FIGS. 11 & 12, another configuration of the RCD 12 is representatively illustrated. In this configuration, the clamp device 22 includes a pressure operated actuator 78 which, when supplied with pressure via the lines 20, can spread apart the ends 62 of the clamp sections 40 (to thereby unclamp the bearing housing assembly 33 from the body 26), or force the ends 62 toward each other (to thereby clamp the bearing housing assembly onto the body).

The RCD 12 configuration of FIGS. 11 & 12 also includes a safety latch 80. The safety latch 80 is used to secure the ends 62 of the clamp sections 40 in their clamped positions (i.e., with the bearing housing assembly 33 securely clamped to the body 26). Thus, the safety latch 80 prevents inadvertent displacement of the ends 62 away from each other.

In FIG. 11, the safety latch 80 is depicted in an unlatched position, in which the actuator 78 may be used to spread the ends 62 of the clamp sections 40 away from each other, for example, to maintain or replace the bearing assembly 32, seals 30, etc. In FIG. 12, the safety latch 80 is depicted in a latched position, in which relative displacement of the ends 62 away from each other is prevented.

The safety latch 80 is preferably remotely operable. In the illustrated example, the safety latch 80 includes a pressure operated actuator 82, a mounting bracket 84, a pivoting bracket 86 and an engagement member 88. The mounting bracket 84 secures the safety latch 80 to the actuator 78.

The actuator 82 may be operated via one or more pressurized lines (not shown) connected to the pressure source 56 and control system 58 of FIG. 6 or FIG. 10. Alternatively, a separate pressure source and control system could be used to operate the actuator 82.

Note that, although the safety latch 80 is depicted as being used with the clamp device 22 which includes the actuator 78, in other examples the safety latch could be used with the other clamp devices described above which include one or more motors 42. The actuators 78, 82 could be hydraulic or pneumatic actuators, or they could be motors or any other types of actuators.

Figure 13:
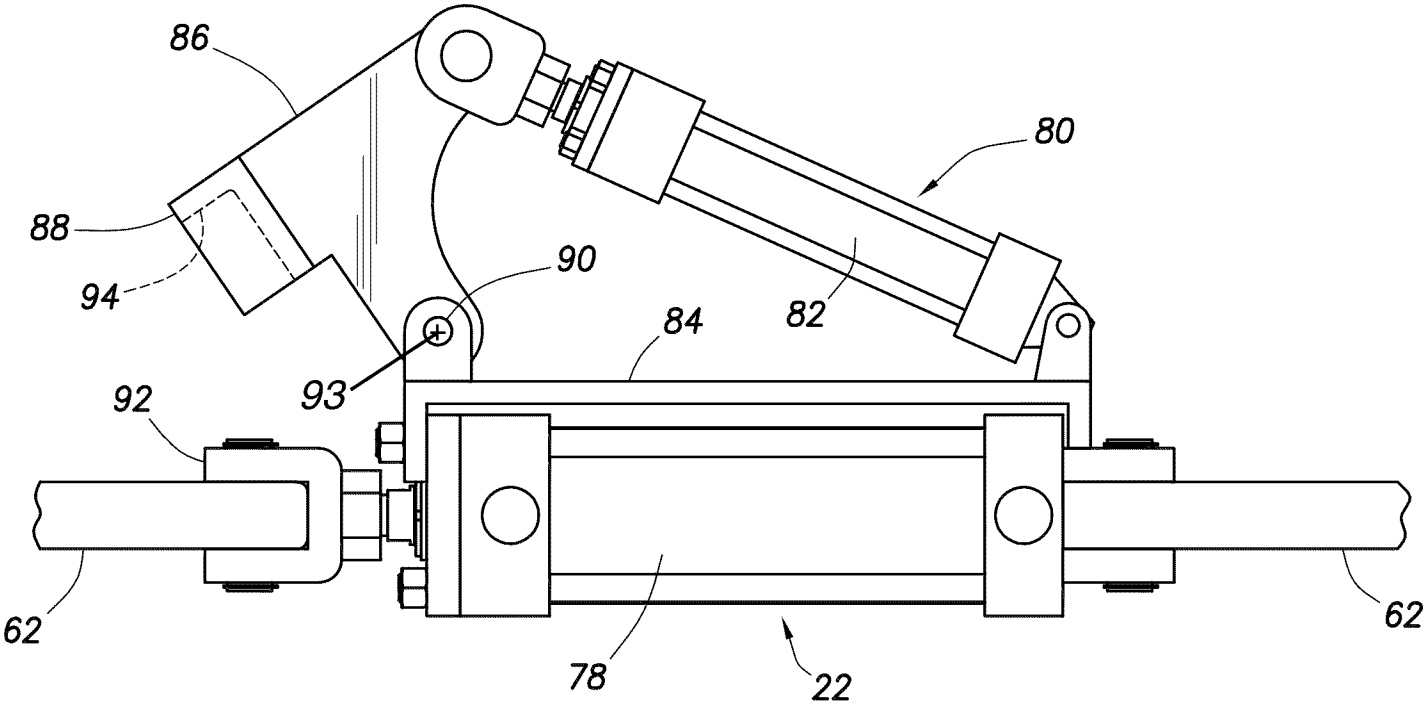
FIG. 13 is a representative enlarged scale side view of the safety latch.

Referring additionally now to FIG. 13, an enlarged scale view of the safety latch 80 is representatively illustrated. In this view, the safety latch 80 is in its unclamped position, permitting the clamp section ends 62 to be spread apart (e.g., by supplying pressure to the actuator 78, thereby elongating the actuator).

However, it will be appreciated that, if the safety latch actuator 82 is elongated (e.g., by supplying pressure to the actuator 82), the bracket 86 will pivot downward about a pivot 90, which has an axis of rotation 93. Eventually, this downward pivoting of the bracket 86 will cause the member 88 to be positioned next to a clevis 92 which pivotably attaches the actuator 78 to one of the clamp section ends 62. In this position of the member 88, the actuator 78 will be blocked from elongating (as depicted in FIG. 12). If such elongating of the actuator 78 is attempted (either intentionally or inadvertently), the clevis 92 will contact an inner surface 94 of the member 88, thereby preventing any significant elongation of the actuator, and preventing unclamping of the bearing housing assembly 33 from the body 26.

In one beneficial use of the safety latch 80, the ability to supply pressure to the clamp device 22 could somehow be lost, so that pressure could not be supplied to the actuator 78 for maintaining the clamp section ends 62 in their clamped position. In that case, the safety latch 80 in its latched position (as depicted in FIG. 12) would prevent the clamp section ends 62 from displacing away from each other, and would thereby prevent the bearing housing assembly 33 from being unclamped from the body 26. However, when it is desired to unclamp the bearing housing assembly 33 from the body 26, the safety latch 80 can conveniently be remotely operated to its unlatched position (e.g., by supplying pressure to the actuator 82) prior to elongating the actuator 78 to spread apart the clamp section ends 62.

Although the RCD 12 in its various configurations is described above as being used in conjunction with the floating rig 16, it should be clearly understood that the RCD can be used with any types of rigs (e.g., on a drill ship, semi-submersible, jack-up, tension leg, land-based, etc., rigs) in keeping with the principles of this disclosure.

Although separate examples of the clamp device 22 are described in detail above, it should be understood that any of the features of any of the described configurations may be used with any of the other configurations. For example, the pneumatic motor 42 of FIGS. 9A & B can be used with the clamp device 22 of FIGS. 3-8B, the pivoting clamp sections 40 of FIGS. 8A-9B can be used with the clamp device of FIGS. 3-7, etc.

Although fluid motors 42 and pressure operated actuators 78, 82 are described above for separate examples of the RCD 12, it should be understood that any type(s) of actuators may be used in any of the examples.

It may now be fully appreciated that the above disclosure provides advancements to the art of operating a clamp device on a rotating control device. The described clamp device 22 and safety latch 80 can be remotely operated, to thereby permit removal and/or installation of the bearing assembly 32 and seals 30, without requiring human activity in close proximity to the RCD 12.

The above disclosure provides to the art a rotating control device 12 which can include a housing assembly 33 which contains a bearing assembly 32 and at least one annular seal 30 which rotates and seals off an annulus 24 between a tubular string 28 and a body 26 of the rotating control device 12, a remotely operable clamp device 22 which selectively permits and prevents displacement of the housing assembly 33 relative to the body 26, and a remotely operable safety latch 80 which selectively permits and prevents unclamping of the clamp device 22.

Pressure may be selectively supplied to the safety latch 80 from a pressure source 56, and the pressure source 56 may be remotely located relative to the safety latch 80. Lubricant may also be supplied from the pressure source 56 to the bearing assembly 32.

The clamp device 22 can include at least one motor 42 which rotates at least one threaded member 44, 70. The clamp device 22 can include a pressure operated actuator 78.

The safety latch 80 can include a pressure operated actuator 82. The safety latch 80 may include an engagement member 88 which, in a latched position, prevents elongation of an actuator 78 of the clamp device 22.

Also described above is a method of remotely operating a clamp device 22 on a rotating control device 12. The method can include remotely operating a safety latch 80 which selectively permits and prevents unclamping of the clamp device 22, and remotely operating the clamp device 22 while the safety latch 80 is in an unlatched position, thereby unclamping a bearing housing assembly 33 from a body 26 of the rotating control device 12.

Remotely operating the safety latch 80 may include supplying pressure to an actuator 82 of the safety latch 80.

Remotely operating the safety latch 80 may include displacing an engagement member 88 which prevents elongation of an actuator 78 of the clamp device 22.

Remotely operating the safety latch 80 may include preventing elongation of an actuator 78 of the clamp device 22.

Remotely operating the clamp device 22 may include supplying pressure to an actuator 78 of the clamp device 22.

Remotely operating the clamp device 22 may include supplying pressure to a fluid motor 42 of the clamp device 22.

Remotely operating the safety latch 80 may include supplying fluid pressure from a location which is remote from the rotating control device 12.

Remotely operating the clamp device 22 may include supplying fluid pressure from a location which is remote from the rotating control device 12.

The above disclosure also provides a rotating control device 12 which can include at least one annular seal 30 which rotates and seals off an annulus 24 between a tubular string 28 and a body 26 of the rotating control device 12, a remotely operable clamp device 22 which selectively permits and prevents access to an interior of the body 26, and a remotely operable safety latch 80 which selectively permits and prevents unclamping of the clamp device 22.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A rotating control device, comprising:

a housing assembly which contains a bearing assembly and at least one annular seal which rotates and seals off an annulus between a tubular string and a body of the rotating control device;

a remotely operable clamp device which selectively permits and prevents displacement of the housing assembly relative to the body, wherein the clamp device includes first and second clamp sections which pivot about a first pivot;

an actuator coupled to the first and second clamp sections, wherein elongation of the actuator unclamps the claim device; and a remotely operable safety latch including an engagement member which selectively permits and prevents unclamping of the clamp device, wherein the engagement member pivots about a second pivot, wherein an axis of rotation of the first pivot is perpendicular to an axis of rotation of the second pivot, and wherein the engagement member is configured to engage with the actuator, locking the actuator in a contracted position, preventing elongation of the actuator.

2. The rotating control device of claim 1, wherein pressure is selectively supplied to the safety latch from a pressure source, and wherein the pressure source is remotely located relative to the safety latch.

3. The rotating control device of claim 2, wherein lubricant is also supplied from the pressure source to the bearing assembly.

4. The rotating control device of claim 1, wherein the clamp device includes at least one motor which rotates at least one threaded member.

5. The rotating control device of claim 1, wherein the actuator of the clamp device comprises a pressure operated actuator.

6. The rotating control device of claim 1, wherein the engagement member is displaced by a pressure operated actuator.

7. A method of remotely operating a clamp device on a rotating control device, the method comprising:

remotely operating an actuator of a safety latch which includes rotating an engagement member about a first pivot, thereby selectively engaging and disengaging the engagement member from a clamp device actuator, wherein when disengaged, the engagement member permits unclamping of the clamp device by permitting elongation of an actuator of the clamp device, and wherein when engaged, the engagement member prevents unclamping of the clamp device by preventing elongation of the actuator of the clamp device; and remotely operating the clamp device while the engagement member is disengaged, thereby unclamping a bearing housing assembly from a body of the rotating control device, wherein the clamp device includes first and second clamp sections which rotate about a second pivot, and wherein an axis of rotation of the first pivot is perpendicular to an axis of rotation of the second pivot.

8. The method of claim 7, wherein remotely operating the safety latch further comprises supplying pressure to the actuator of the safety latch.

9. The method of claim 7, wherein remotely operating the clamp device further comprises supplying pressure to the actuator of the clamp device.

10. The method of claim 7, wherein remotely operating the clamp device further comprises supplying pressure to a fluid motor of the clamp device.

11. The method of claim 7, wherein remotely operating the safety latch further comprises supplying fluid pressure from a location which is remote from the rotating control device.

12. The method of claim 7, wherein remotely operating the clamp device further comprises supplying fluid pressure from a location which is remote from the rotating control device.

13. A rotating control device, comprising:

at least one annular seal which rotates and seals off an annulus between a tubular string and a body of the rotating control device;

a remotely operable clamp device which selectively permits and prevents access to an interior of the body, wherein the clamp device includes first and second clamp sections which are pivotally mounted to the body at a first pivot;

an actuator configured to clamp and unclamp the first and second clamp sections; and a remotely operable safety latch configured to selectively permit and prevent unclamping of the clamp device, wherein the safety latch includes an engagement member which is configured to controllably engage with and disengage from the actuator, locking the actuator when engaged to prevent the actuator from unclamping the first and second clamp sections.

14. The rotating control device of claim 13, wherein pressure is selectively supplied to the safety latch from a pressure source, and wherein the pressure source is remotely located relative to the safety latch.

15. The rotating control device of claim 13, wherein the clamp device includes at least one motor which rotates at least one threaded member.

16. The rotating control device of claim 13, wherein the actuator of the clamp device comprises a pressure operated actuator.

17. The rotating control device of claim 13, wherein the engagement member is displaced by a pressure operated actuator.

18. The rotating control device of claim 13, wherein the engagement member is pivotally mounted to a second pivot, wherein an axis of rotation of the first pivot is perpendicular to an axis of rotation of the second pivot.

* * * * *